US005954216A

United States Patent [19]

Meisner et al.

[11] Patent Number: 5,954,216

[45] **Date of Patent: *Sep. 21, 1999**

[54] CONTAINER WITH INTEGRAL ERGONOMIC HANDLE

[75] Inventors: Edward H. Meisner, Short Hills, N.J.; Roland Charriez, Peekskill, N.Y.; Thomas Van Dyk, Ramsey, N.J.; Keith Kristiansen, Stratford, Conn.

[73] Assignee: Great Spring Waters of America, Inc., Greenwich, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/012,797

[22] Filed: Jan. 23, 1998

[51] Int. Cl.[6] ..... B65D 25/28

[52] U.S. Cl. ..... 215/398; 215/384

[58] Field of Search ..... 215/398, 396, 215/382, 383, 384; 220/771, 770, 761, 756

[56] References Cited

U.S. PATENT DOCUMENTS

| | | | |
|---|---|---|---|
| D. 189,996 | 3/1961 | Stenger et al. | D58/8 |
| D. 207,130 | 3/1967 | Drucker | 215/398 |
| D. 223,601 | 5/1972 | Johnson | 215/398 |
| D. 227,654 | 7/1973 | Byrne | D9/1 |
| D. 233,595 | 11/1974 | Sinding | D9/1 |
| D. 265,460 | 7/1982 | Wilson | D9/378 |
| D. 268,480 | 4/1983 | Cox | D9/378 |
| D. 270,136 | 8/1983 | Cox | D9/350 |
| D. 303,496 | 9/1989 | Larson | D9/370 |
| D. 303,497 | 9/1989 | Larson | D9/370 |
| D. 307,389 | 4/1990 | Larson | D9/370 |
| D. 313,177 | 12/1990 | Larson | D9/370 |
| D. 320,344 | 10/1991 | Larson | D9/370 |
| D. 322,936 | 1/1992 | Maginnis, Jr. | D9/397 |
| D. 323,983 | 2/1992 | Bastidos | D9/378 |
| D. 324,650 | 3/1992 | Larson | D9/370 |
| D. 326,051 | 5/1992 | Frahm | D9/558 |
| D. 326,609 | 6/1992 | Stenger | D9/502 |
| D. 327,219 | 6/1992 | Hestehave et al. | D9/530 |
| D. 333,098 | 2/1993 | Hestehave et al. | D9/531 |
| D. 338,405 | 8/1993 | Charbonneau et al. | D9/520 |
| D. 339,067 | 9/1993 | Rokus | D9/531 |
| D. 341,314 | 11/1993 | Charbonneau et al. | D9/520 |
| D. 344,024 | 2/1994 | Charbonneau et al. | D9/520 |
| D. 345,693 | 4/1994 | Edstrom | D9/332 |
| D. 346,332 | 4/1994 | Kanfer et al. | D9/531 |
| D. 355,365 | 2/1995 | Charbonneau et al. | D9/524 |
| D. 355,367 | 2/1995 | Rokus | D9/531 |
| D. 360,830 | 8/1995 | Hestehave et al. | D9/520 |
| D. 361,039 | 8/1995 | Rokus | D9/531 |
| D. 390,113 | 2/1998 | Rauch | D9/520 |
| D. 391,160 | 2/1998 | Lauth | D9/502 |
| D. 391,161 | 2/1998 | Lauth | D9/503 |
| D. 396,807 | 8/1998 | Lauth | D9/503 |
| D. 397,942 | 9/1998 | Lewis | D9/531 |
| 3,069,039 | 12/1962 | Stickney | 215/1 |
| 3,198,367 | 8/1965 | Stickney | 215/1 |
| 3,708,082 | 1/1973 | Platte | 215/1 C |
| 4,046,275 | 9/1977 | Virog, Jr. et al. | 215/1 C |
| 4,051,265 | 9/1977 | Kirschenbaum et al. | 426/107 |
| 4,127,206 | 11/1978 | Virog, Jr. et al. | 215/1 C |
| 4,143,784 | 3/1979 | Frahm et al. | 215/12 R |
| 4,372,455 | 2/1983 | Cochran | 215/100 A |
| 4,805,808 | 2/1989 | Larson | 222/185 |

(List continued on next page.)

*Primary Examiner*—Stephen Castellano
*Attorney, Agent, or Firm*—Fish & Neave; Jeffrey H. Ingerman

[57] ABSTRACT

A water cooler water bottle has a recessed handle angled to provide a natural lifting angle for a user, without bending the user's wrist. The handle is positioned adjacent the center of gravity of the bottle so that the center of gravity is substantially or directly under the handle when the user is carrying the bottle, and so that inversion of the bottle for insertion into a water cooler is easier. The side wall tapers smoothly into the handle and the recess so that during cleaning, cleaning liquid does not pool at the handle or the recess and remain in the bottle.

27 Claims, 4 Drawing Sheets

U.S. PATENT DOCUMENTS

| | | | |
|---|---|---|---|
| 4,846,359 | 7/1989 | Baird et al. | 215/12.2 |
| 5,087,406 | 2/1992 | Krall et al. | 264/512 |
| 5,133,469 | 7/1992 | Mehta et al. | 215/10 |
| 5,139,666 | 8/1992 | Charbonneau et al. | 210/264 |
| 5,207,338 | 5/1993 | Sandhu | 215/11.1 |
| 5,232,107 | 8/1993 | Krall et al. | 215/1 C |
| 5,275,780 | 1/1994 | Robinson | 264/529 |
| 5,485,942 | 1/1996 | Foster | 215/398 |

CONTAINER WITH INTEGRAL ERGONOMIC HANDLE

BACKGROUND OF THE INVENTION

This invention relates to containers with integral handles. More particularly, this invention relates to a container having an integral handle positioned ergonomically on the container.

Bottled water for use in a dispensing machine of the type commonly referred to as a "water cooler" is normally provided in a 5-gallon (18.9 l) bottle. A conventional bottle of that type has a substantially cylindrical side wall, a substantially flat end wall at one end of the substantially cylindrical side wall, and a shoulder at the other end of the substantially cylindrical side wall tapering into a neck having an opening through which water is drawn from the bottle and through which the bottle is filled. In use, the bottle is normally inverted on the dispensing machine with its neck inserted into a suitable port in the dispensing machine with the substantially flat end wall facing upward. However, the bottle is typically stored with its neck facing upward, with the substantially flat end wall resting on the floor. Therefore, the substantially flat end wall may be referred to as the base.

A full water cooler water bottle is heavy. Five gallons of water at room temperature weigh about 42 pounds (about 18.9 kg), and some weight is added by the bottle itself. In order to load a water cooler bottle into a water cooler, it is necessary to lift the bottle to the top of the water cooler—typically between about three feet (about 0.91 m) and about four feet (about 1.21 m) above the floor, and then invert it so that the neck is facing downward into the port on the water cooler. In addition, while the typical water cooler consumer receives his or her water from a water delivery service which transports the water bottles to a storage area on the consumer's premises, that storage area may not be immediately adjacent the water cooler. Therefore, the consumer may also have to transport the heavy water bottle from its storage area to the water cooler. Moreover, delivery service personnel also must be able to carry the water bottle from a delivery vehicle to the consumer's storage area.

The traditional water cooler water bottle has no handle. Therefore, in order to transport or lift the bottle, the delivery service personnel or the consumer (hereinafter the "user") was required to get his or her arms around the bottle, or to carry the bottle by its neck, which is not suitable for lifting the bottle to the cooler. Water cooler water bottles with handles are also known. However, in some known water bottles with handles, the handles are in, and parallel to, the side wall. That means that when a user reaches out with his or her arm angled downward to lift the bottle from its resting position, the user's wrist must be bent into an unnatural angle. In other known bottles, the handle is angled into a more natural position for lifting of the bottle by the user—e.g., the handle follows the contour of the shoulder near the neck. However, in such bottles, the handle is far from the center of gravity of the bottle, meaning that the consumer must exert a lot of torque to invert the bottle, which once inverted will be very unstable because the slightest movement by the consumer can cause the center of gravity to move sideways and cause the inverted bottle to tip. Moreover, such handles result in a change in the shape of the shoulder area of the bottle so that it no longer fits properly in the port of the water cooler.

In addition, empty water cooler water bottles are normally collected by the water delivery service for refilling and reuse. Before the water bottles are refilled they are cleaned.

In one common cleaning method, the bottle is inverted, and cleaning and rinsing liquid is injected upward into the bottle opening under pressure. The liquid hits the inverted base at the top of the inverted bottle, runs down the sides and exits the bottle at the opening in the neck. However, in known bottles with handles in the side, a recess is formed around the handle to accommodate the user's hand. During cleaning, one or more surfaces of the recess may cause pooling of the cleaning or rinsing liquid, which may then remain in the bottle during and after refilling.

Finally, many of the handles molded into known water cooler water bottles have oval cross sections, making it uncomfortable for a user to hold the handle for any significant length of time.

It would be desirable to be able to provide a water cooler water bottle having a handle that is angled to provide a more natural lifting position for the user.

It would also be desirable to be able to provide such a bottle that is more easily inverted.

It would further be desirable to be able to provide such a bottle that can be cleaned without having cleaning liquid remain in the bottle.

It would still further be desirable to be able to provide such a bottle in which the shape of handle is more comfortable for the user.

SUMMARY OF THE INVENTION

It is an object of this invention to provide a water cooler water bottle having a handle that is angled to provide a more natural lifting position for the user.

It is another object of this invention to provide such a bottle that is more easily inverted.

It is a further object of this invention to provide such a bottle that can be cleaned without having cleaning liquid remain in the bottle.

It is a still further object of this invention to provide such a bottle in which the shape of handle is more comfortable for the user.

In accordance with the present invention there is provided a container for use with a liquid dispenser having a liquid-receiving port in a surface thereof. The container has a substantially cylindrical side wall defining a central longitudinal axis and having first and second ends. An end wall is joined to the first end of the substantially cylindrical side wall. The end wall is substantially perpendicular to said central longitudinal axis. A shoulder is joined to the second end of the substantially cylindrical side wall tapering toward the central longitudinal axis in a direction away from the first end. A neck is joined to the shoulder substantially centered on the central longitudinal axis. The neck has an opening therein. The side wall, the end wall, the shoulder and the neck form a chamber for containing a liquid, with the opening providing access for adding liquid to and removing liquid from the chamber. The container has a center of gravity. The container further has a handle formed in the substantially cylindrical side wall, the substantially cylindrical side wall having a handle recess formed therein. The handle extends across the handle recess, which is for accommodating a user's hand when the user's hand engages the handle. The handle has a first handle end facing the end wall and a second handle end facing the shoulder, and has a handle longitudinal axis extending therethrough from the first handle end to the second handle end. The first handle end is further than the second handle end from the central longitudinal axis. Preferably, the handle is hollow, and the first handle end is adjacent the substantially cylindrical side wall, which preferably tapers smoothly into the handle and the recess.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 4 is a fragmentary cross-sectional view of the container of FIGS. 1–3, taken from line 4—4 of FIG. 3.

DETAILED DESCRIPTION OF THE INVENTION

Figure 1:
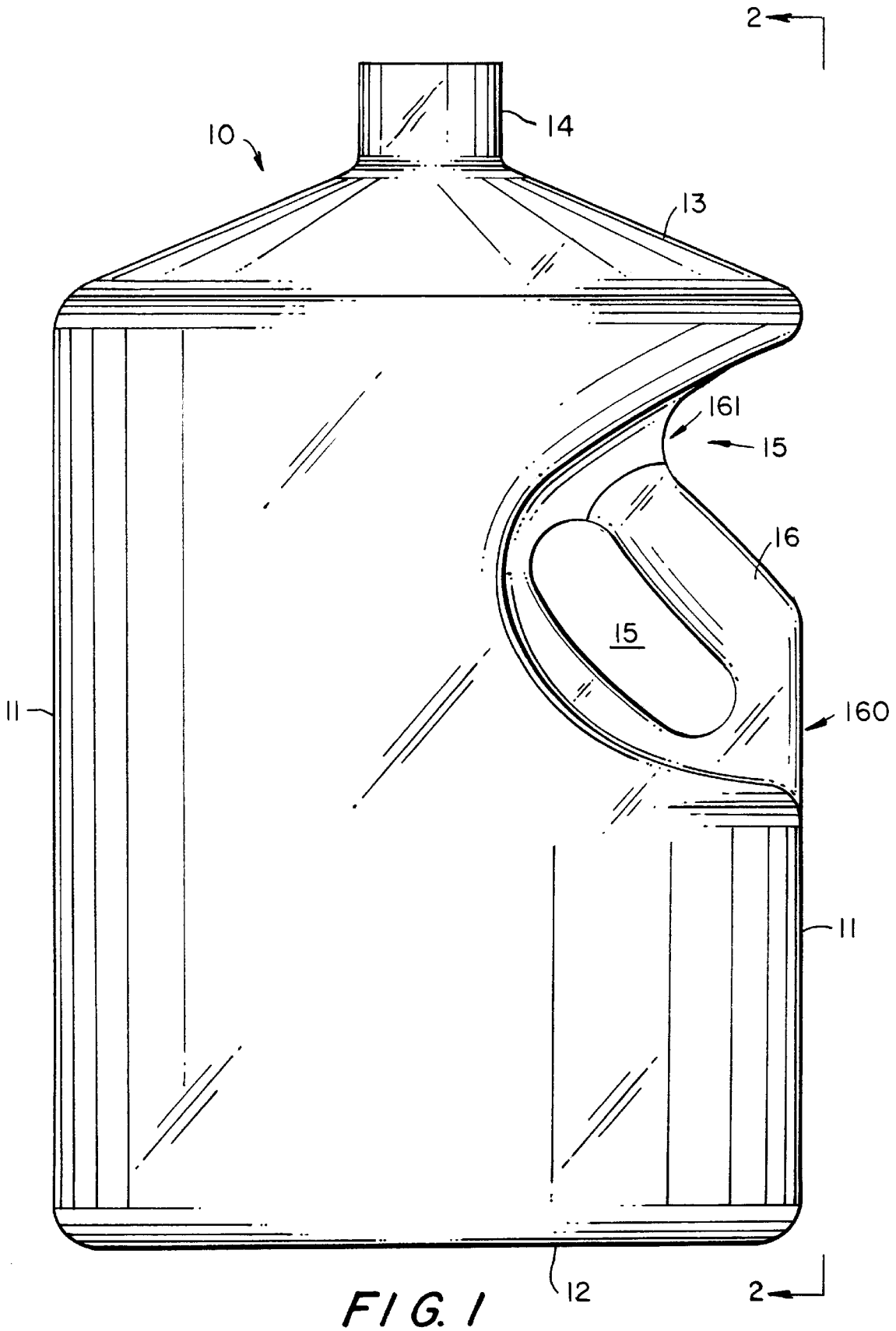
FIG. 1 is a side elevational view of a preferred embodiment of a container according to the present invention.
Figure 2:
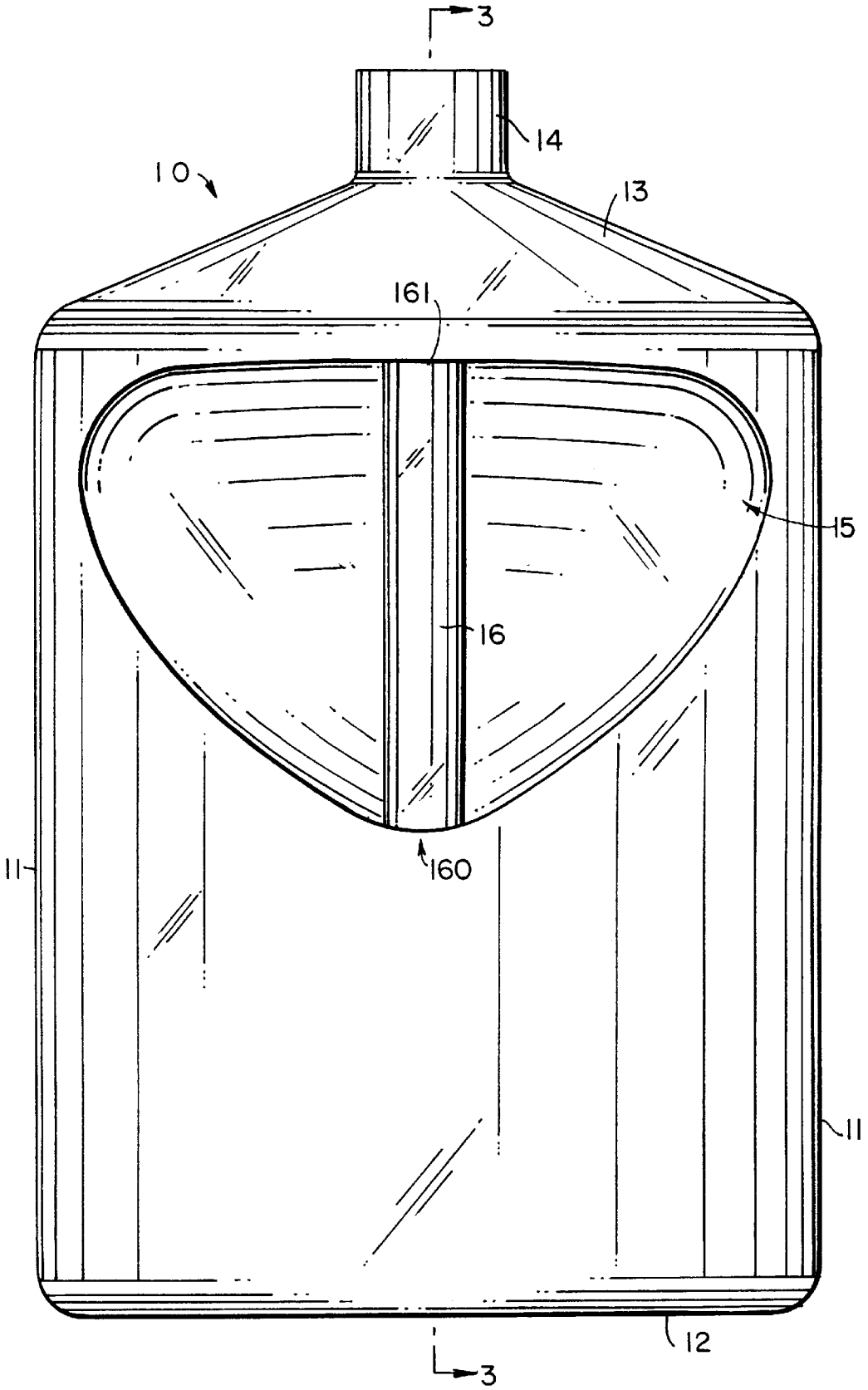
FIG. 2 is a side elevational view of the container of FIG. 1, taken from line 2—2 of FIG. 1.

The present invention provides a container with a handle configuration that makes the container easier to lift and carry, as well as easier to invert for installation into a water cooler. The handle, which preferably has a substantially circular cross section to make it more comfortable to hold for longer periods than an oval cross section, is angled with respect to the central longitudinal, or vertical, axis of the container. The angle of the longitudinal axis of the handle relative to the central longitudinal axis is approximately the angle one's arm makes with one's body when one reaches for the handle, so that unnatural bending of the wrist is not required when lifting the container from the floor.

The handle is preferably adjacent to the center of gravity of the container. That way, there are comparable masses above and below the handle, reducing the amount of torque necessary to invert the container, and increasing the stability of the inverted container relative to the handle, as compared to a container in which the handle is at one end of the central longitudinal axis. By "adjacent" is meant that a line perpendicular to the longitudinal axis of the handle passing through the center of gravity of the container also passes through the handle, or intersects the handle longitudinal axis at a distance from an end of the handle at most about 10% of the length of the handle, and preferably no greater than about 5% of the length of the handle. This means that when the container is being carried, with the handle longitudinal axis in a substantially horizontal orientation, the center of gravity is substantially below the handle for stability and ease of carrying. More preferably, a line perpendicular to the longitudinal axis of the handle passing through the center of gravity of the container actually passes through the handle, and most preferably substantially through the center of the handle. This means that when the container is being carried, with the handle longitudinal axis in a horizontal orientation, the center of gravity is directly below the handle—most preferably directly below the center of the handle, for greatest stability and ease of carrying.

The handle is preferably hollow, so that the liquid in the container is in the handle as well. The bottom end of the handle preferably is at the side wall (rather than intersecting the wall of the recess away from the side wall), and the side wall preferably tapers smoothly into the handle and into the recess. In this way, when the container is being cleaned as described above, the cleaning and rinsing liquids can easily run into and through the handle through the bottom end (which is on top in the inverted position), or over the wall of the recess, without pooling near the bottom end of the handle. The other end of the handle intersects the top (bottom when inverted) of the recess, so that the shape of the shoulder is unaffected, allowing it to fit properly into the port on the water cooler.

The container according to the invention will now be described in connection with the preferred embodiment of FIGS. 1–5.

Container 10 according to the invention is preferably a five-gallon (18.9 l) blow-molded container, preferably made from a substantially transparent material, and most preferably made from polycarbonate. Container 10 preferably has a substantially cylindrical side wall 11. At one end of substantially cylindrical side wall 11, an end cap 12 preferably is attached. Because end cap 12 preferably forms the surface on which container 10 normally rests when it is not loaded into a water cooler, end cap 12 may also be referred to as the base of container 10. At the other end of substantially cylindrical side wall 11, a shoulder 13 preferably is attached, which preferably tapers to a neck 14 having an opening 30 through which water or other liquid may be inserted and removed. Neck 14 and opening 30 preferably are substantially centered on the central longitudinal axis 31 of container 10.

The shape of container 10 is preferably substantially conventional for a water cooler water bottle. Although not shown in FIGS. 1–5, container 10 may have surface features such as raised bands for increased rigidity, as is well known. In addition, it may have surface ornamentation (not shown), also as is well known, such as a pebble-type finish on parts of its outer surface.

In accordance with the present invention, a recess 15 is formed in substantially cylindrical side wall 11, and a handle 16 preferably is formed extending generally vertically across recess 15. By "vertically" is meant that handle longitudinal axis 32, although preferably inclined as discussed below, lies in a vertical plane (not shown) through which central longitudinal axis 31 preferably also passes. At its bottom end 160, handle 16 preferably is substantially adjacent side wall 11 and preferably tapers smoothly into side wall 11, as does recess 15, for reasons that will be discussed below. At its upper end 161, handle 16 is closer to central longitudinal axis 31, and farther from side wall 11, than it is at bottom end 160. Handle 16 preferably is hollow and its interior preferably communicates with chamber 33, which is formed by the exterior components of container 10 and which in use preferably contains water.

Figure 3:
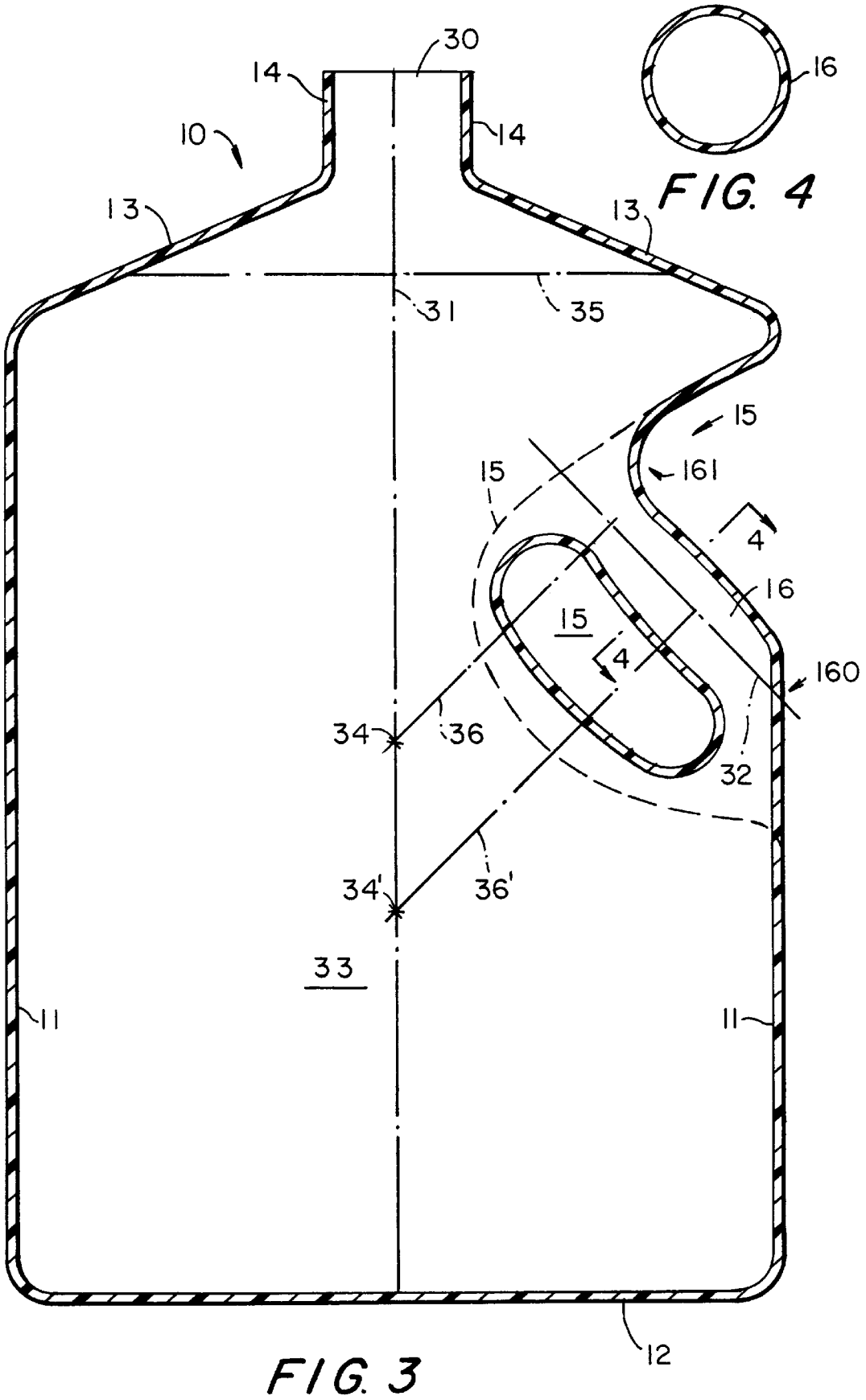
FIG. 3 is a vertical cross-sectional view of the container of FIGS. 1 and 2, taken from line 3—3 of FIG. 2.

The nominal position of the center of gravity of container 10 is shown at 34 in FIG. 3, about midway along central longitudinal axis 31. This is the nominal location of the center of gravity when container 10 is full to the top or when it is empty.

As stated above, handle 16 is substantially adjacent center of gravity 34, meaning that a line 36 passing through center of gravity 34 perpendicular to handle longitudinal axis 32 intersects handle longitudinal axis 32 within a distance from an end of handle 16 that is at most about 10% from that end of handle 16, and preferably at most about 5% from that end of handle 16. (As shown in FIG. 3, line 36 actually intersects handle 16 near end 161, an even more preferable condition.) This means that when a consumer holds container 10 by handle 16, with central longitudinal axis 31 aligned vertically, the amount of mass above handle 16 is comparable to the amount of mass below handle 16, so that container 10 preferably may be inverted with a minimum of torque, and preferably will be relatively stable once inverted.

If bottle 10 is filled only to line 35 (a more likely scenario), the center of gravity will be lower—e.g., at about 34'. As can be seen, in this most preferable condition, line 36' intersects handle longitudinal axis 32 at about the center of handle 16.

Handle 16 is inclined as discussed above. Preferably, handle longitudinal axis 32 is inclined between about 37° and about 47°, and most preferably about 42°, relative to central longitudinal axis 31. This approximates the angle at which one's arm extends from one's body when one reaches to lift container 10, so that no unnatural bending of one's wrist is required.

In addition, the angling of handle 16 means that when a user is carrying container 10, with handle 16 substantially horizontal, center of gravity 34 is substantially or directly under handle 16, so that there is substantially no torque applied to the user's wrist. In the most preferred location of the center of gravity 34' as discussed above, center of gravity 34' is directly below the center of handle 16 when handle 16 is horizontal, resulting in the smallest possible torque applied to the user's wrist.

As shown in FIG. 4, handle 16 preferably has a substantially circular cross section. Handle 16 is therefore more comfortable to hold, particularly for long periods, than previously known handles with oval cross sections.

Figure 5:
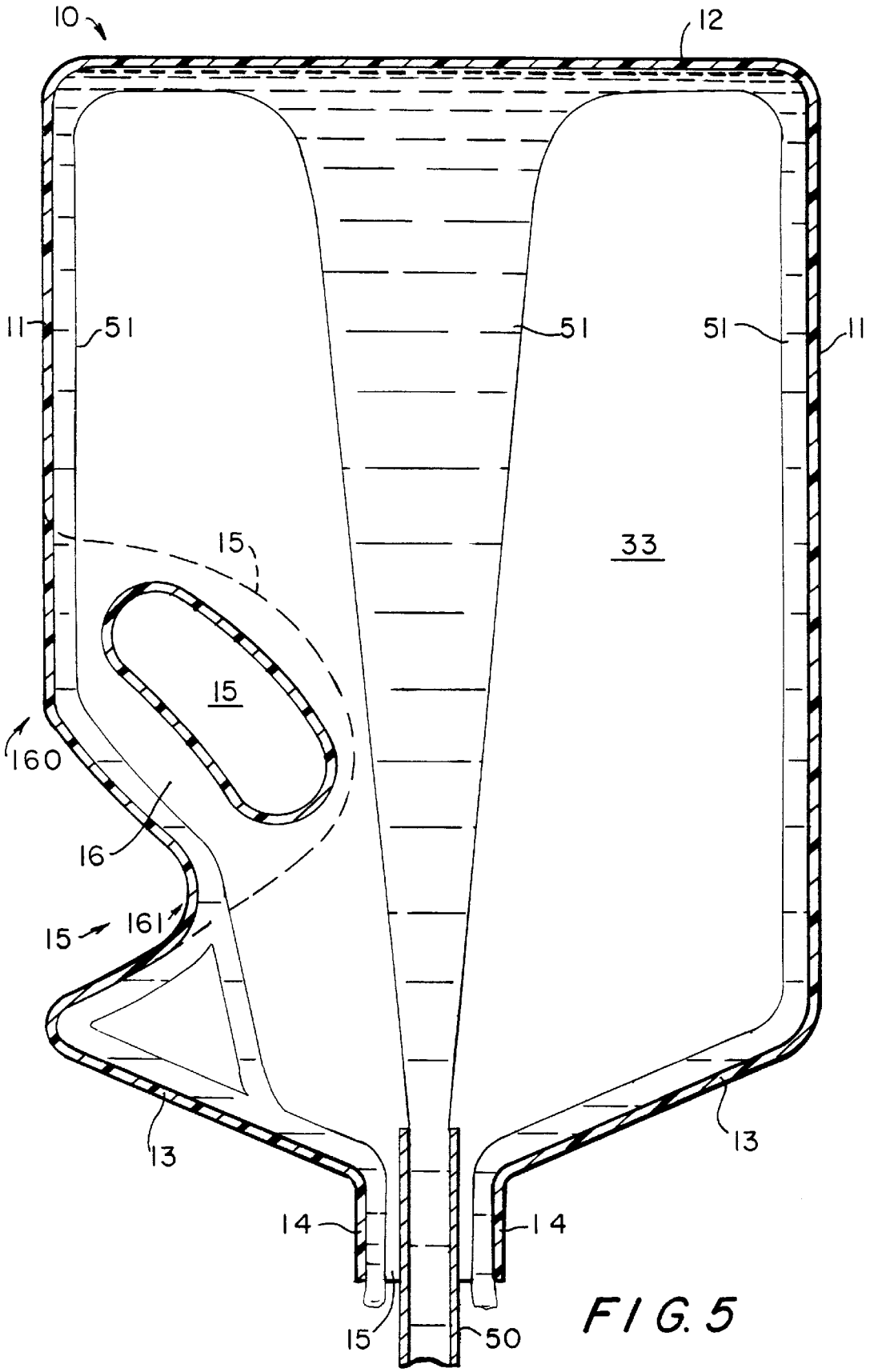
FIG. 5 is a vertical cross-sectional view of the container of FIGS. 1–4 in an inverted position, taken along the same plane as FIG. 3, with a cleaning nozzle inserted.

FIG. 5 shows container 10 inverted for cleaning, with cleaning nozzle 50 inserted in opening 15, spraying liquid 51, which may be water or another liquid, to clean the interior of chamber 33. As can be seen, liquid 51 hits the interior of end wall 12 and runs down the inside of side wall 11. When the stream of liquid 51 running down side wall 11 reaches bottom end 160 (now on top because container 10 is inverted), the smooth taper of side wall 11 into recess 15 and into handle 16 allows liquid 51 to flow smoothly into handle 16 and out upper end 161 (now on bottom), or over the wall of recess 15, without pooling at bottom end 160 of handle 16. Liquid 51 then continues out opening 15. This assures complete cleaning and rinsing of container 10 without leaving any of liquid 51 within container 10.

Thus it is seen that a water cooler water bottle having a handle that is angled to provide a more natural lifting position for the user, that is more easily inverted then previously known bottles, that can be cleaned without having cleaning liquid remain in the bottle, and that has a handle with a shape that is more comfortable for the user, has been provided. One skilled in the art will appreciate that the present invention can be practiced by other than the described embodiments, which are presented for purposes of illustration and not of limitation, and the present invention is limited only by the claims which follow.

What is claimed is:

1. A container for use with a liquid dispenser having a liquid-receiving port in a surface thereof, said container comprising:

a substantially cylindrical side wall defining a central longitudinal axis and having first and second ends;

an end wall joined to said first end of said substantially cylindrical side wall, said end wall being substantially perpendicular to said central longitudinal axis;

a shoulder joined to said second end of said substantially cylindrical side wall tapering toward said central longitudinal axis in a direction away from said first end; and a neck joined to said shoulder substantially centered on said central longitudinal axis and having an opening therein; wherein:

said side wall, said end wall, said shoulder and said neck form a chamber for containing a liquid, said opening providing access for adding liquid to and removing liquid from said chamber;

said container has a center of gravity; and said container further comprises:

a handle formed in said substantially cylindrical side wall, said substantially cylindrical side wall having a handle recess formed therein surrounding said handle, said shoulder extending substantially completely over said handle recess to form a surface for engagement with said port, said handle extending across said handle recess, said handle recess being for accommodating a user's hand within said side wall when said user's hand engages said handle; wherein:

said handle has a first handle end facing said end wall and a second handle end facing said shoulder; and said handle has a handle longitudinal axis extending therethrough from said first handle end to said second handle end, said first handle end being further than said second handle end from said central longitudinal axis.

2. The container of claim 1 wherein said handle is adjacent said center of gravity, whereby a user holding said container by said handle can easily invert said container for insertion of said neck into said liquid-receiving port.

3. The container of claim 2 wherein:

said handle is located at a first position measured along said central longitudinal axis; and said center of gravity is located at a second position measured along said central longitudinal axis; and said first and second positions are adjacent one another.

4. The container of claim 3 wherein said first position is closer to said neck than said second position.

5. The container of claim 2 wherein:

said handle has a handle length between said first handle end and said second handle end, and a center point midway along said handle length; and a line perpendicular to said handle longitudinal axis passing through said center of gravity intersects said handle longitudinal axis at distance from an end of said handle at most equal to about 10% of said handle length.

6. The container of claim 5 wherein said line perpendicular to said handle longitudinal axis passing through said center of gravity intersects said handle longitudinal axis at distance from said end of said handle at most equal to about 5% of said handle length.

7. The container of claim 6 wherein said line perpendicular to said handle longitudinal axis passing through said center of gravity intersects said handle.

8. The container of claim 7 wherein said line perpendicular to said handle longitudinal axis passing through said center of gravity intersects said handle substantially at said center point.

9. The container of claim 1 wherein:

said handle has a cross section perpendicular to said handle longitudinal axis; and said cross section is substantially circular.

10. The container of claim 1 wherein:

said handle is hollow, having a space therein communicating with said chamber at said first handle end and at said second handle end;

said first handle end is substantially adjacent said substantially cylindrical side wall; and said substantially cylindrical side wall tapers substantially smoothly into said handle and into said recess.

11. The container of claim 1 wherein said handle longitudinal axis makes an angle of between about 37° and about 47° with said central longitudinal axis.

12. The container of claim 11 wherein said angle is about 42°.

13. A container comprising:

a substantially cylindrical side wall defining a central longitudinal axis and having first and second ends;

an end wall joined to said first end of said substantially cylindrical side wall, said end wall being substantially perpendicular to said central longitudinal axis;

a shoulder joined to said second end of said substantially cylindrical side wall tapering toward said central longitudinal axis in a direction away from said first end; and a neck joined to said shoulder substantially centered on said central longitudinal axis and having an opening therein; wherein:

said side wall, said end wall, said shoulder and said neck form a chamber for containing a liquid, said opening providing access for adding liquid to and removing liquid from said chamber; and said container further comprises:

a handle formed in said substantially cylindrical side wall, said substantially cylindrical side wall having a handle recess formed therein surrounding said handle, said shoulder extending substantially completely over said handle recess to form a surface for engagement with a port of a liquid dispenser with which said container is adapted to be used, said handle extending across said handle recess, said handle recess being for accommodating a user's hand within said side wall when said user's hand engages said handle; wherein:

said handle has a first handle end facing said end wall and a second handle end facing said shoulder; and said handle has a handle longitudinal axis extending therethrough from said first handle end to said second handle end, said first handle end being further than said second handle end from said central longitudinal axis;

said handle is hollow, having a space therein communicating with said chamber at said first handle end and at said second handle end;

said first handle end is substantially adjacent said substantially cylindrical side wall; and said substantially cylindrical side wall tapers substantially smoothly into said handle and into said recess.

14. The container of claim 13 wherein said handle longitudinal axis makes an angle of between about 37° and about 47° with said central longitudinal axis.

15. The container of claim 14 wherein said angle is about 42°.

16. In combination, a liquid dispenser having a liquid-receiving port in a surface thereof and a container for use with said liquid dispenser, said container comprising:

a substantially cylindrical side wall defining a central longitudinal axis and having first and second ends;

an end wall joined to said first end of said substantially cylindrical side wall, said end wall being substantially perpendicular to said central longitudinal axis;

a shoulder joined to said second end of said substantially cylindrical side wall tapering toward said central longitudinal axis in a direction away from said first end; and a neck joined to said shoulder substantially centered on said central longitudinal axis and having an opening therein; wherein:

said side wall, said end wall, said shoulder and said neck form a chamber for containing a liquid, said opening providing access for adding liquid to and removing liquid from said chamber;

said container has a center of gravity; and said container further comprises:

a handle formed in said substantially cylindrical side wall, said substantially cylindrical side wall having a handle recess formed therein surrounding said handle, said shoulder extending substantially completely over said handle recess to form a surface for engagement with said port, said handle extending across said handle recess, said handle recess being for accommodating a user's hand within said side wall when said user's hand engages said handle; wherein:

said handle has a first handle end facing said end wall and a second handle end facing said shoulder; and said handle has a handle longitudinal axis extending therethrough from said first handle end to said second handle end, said first handle end being further than said second handle end from said central longitudinal axis.

17. The combination of claim 16 wherein said handle is adjacent said center of gravity, whereby a user holding said container by said handle can easily invert said container for insertion of said neck into said liquid-receiving port.

18. The combination of claim 17 wherein:

said handle is located at a first position measured along said central longitudinal axis; and said center of gravity is located at a second position measured along said central longitudinal axis; and said first and second positions are adjacent one another.

19. The combination of claim 18 wherein said first position is closer to said neck than said second position.

20. The combination of claim 17 wherein:

said handle has a handle length between said first handle end and said second handle end, and a center point midway along said handle length; and a line perpendicular to said handle longitudinal axis passing through said center of gravity intersects said handle longitudinal axis at distance from an end of said handle at most equal to about 10% of said handle length.

21. The combination of claim 20 wherein said line perpendicular to said handle longitudinal axis passing through said center of gravity intersects said handle longitudinal axis at distance from said end of said handle at most equal to about 5% of said handle length.

22. The combination of claim 21 wherein said line perpendicular to said handle longitudinal axis passing through said center of gravity intersects said handle.

23. The combination of claim 22 wherein said line perpendicular to said handle longitudinal axis passing through said center of gravity intersects said handle substantially at said center point.

24. The combination of claim 16 wherein:

said handle has a cross section perpendicular to said handle longitudinal axis; and said cross section is substantially circular.

25. The combination of claim 16 wherein:

said handle is hollow, having a space therein communicating with said chamber at said first handle end and at said second handle end;

said first handle end is substantially adjacent said substantially cylindrical side wall; and said substantially cylindrical side wall tapers substantially smoothly into said handle and into said recess.

26. The combination of claim 16 wherein said handle longitudinal axis makes an angle of between about 37° and about 47° with said central longitudinal axis.

27. The combination of claim 26 wherein said angle is about 42°.

* * * * *